United States Patent [19]

Carl et al.

[11] 3,987,856

[45] Oct. 26, 1976

[54] KELLY CROWD FOR VERTICAL DRILL RIG

[75] Inventors: Joseph A. Carl, Tucson, Ariz.; John F. Steinke, Fountain Valley; David M. Bloss, Fullerton, both of Calif.

[73] Assignee: Smith International, Inc., Newport Beach, Calif.

[22] Filed: Nov. 13, 1975

[21] Appl. No.: 631,443

[52] U.S. Cl. ..... 173/149; 175/162

[51] Int. Cl.[2] ..... E21B 3/04; E21B 7/02

[58] Field of Search ..... 173/149; 175/162

[56] References Cited

UNITED STATES PATENTS

| | | | |
|---|---|---|---|
| 1,692,431 | 11/1928 | Anderson | 173/149 |
| 2,730,331 | 1/1956 | Harinck | 173/149 |
| 3,094,312 | 6/1963 | Woolgar | 173/149 X |
| 3,708,020 | 1/1973 | Adamson | 173/149 X |

*Primary Examiner*—Ernest R. Purser

[57] ABSTRACT

A vertical drill rig having a drive kelly, a drilling tool supported from the lower end of the drive kelly, a rotary table, and a friction crowd for imparting via the drive kelly to the drilling tool a vertical driving force which is in excess of that provided by gravity alone. The disclosed friction crowd assembly includes concentric inner and outer sleeves, the outer sleeve being supported from the rotary table while the inner sleeve is vertically movable relative both to the outer sleeve and to the drive kelly. Rotary movement is imparted by means of first interengaging rib and keyway means from the outer sleeve to the inner sleeve, and by means of second interengaging rib and keyway means from the inner sleeve to the drive kelly. Crowding of the kelly is accomplished by applying a separate vertical driving movement to the inner sleeve.

11 Claims, 15 Drawing Figures

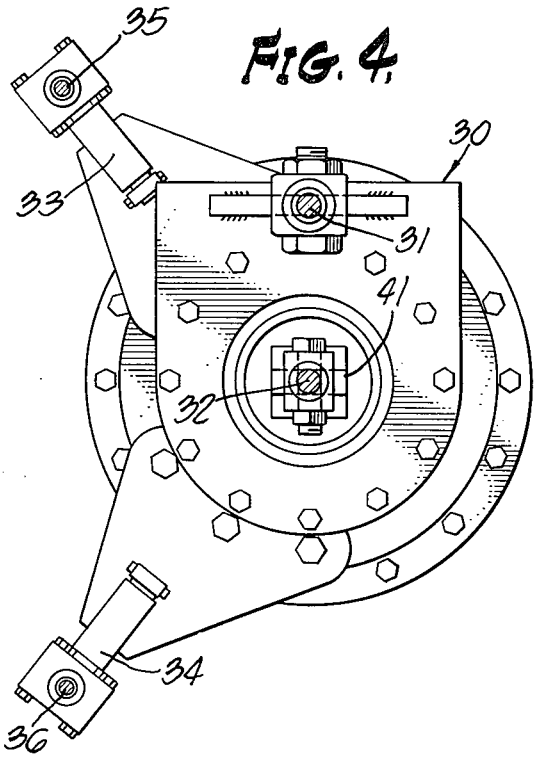
FIG. 4.
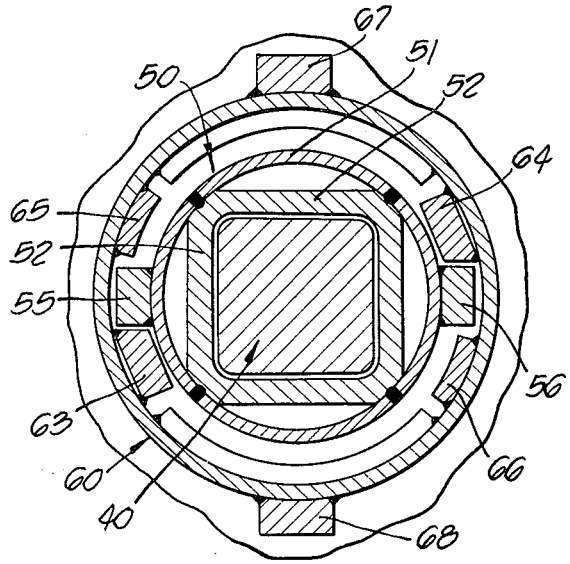
FIG. 5.
FIG. 6.
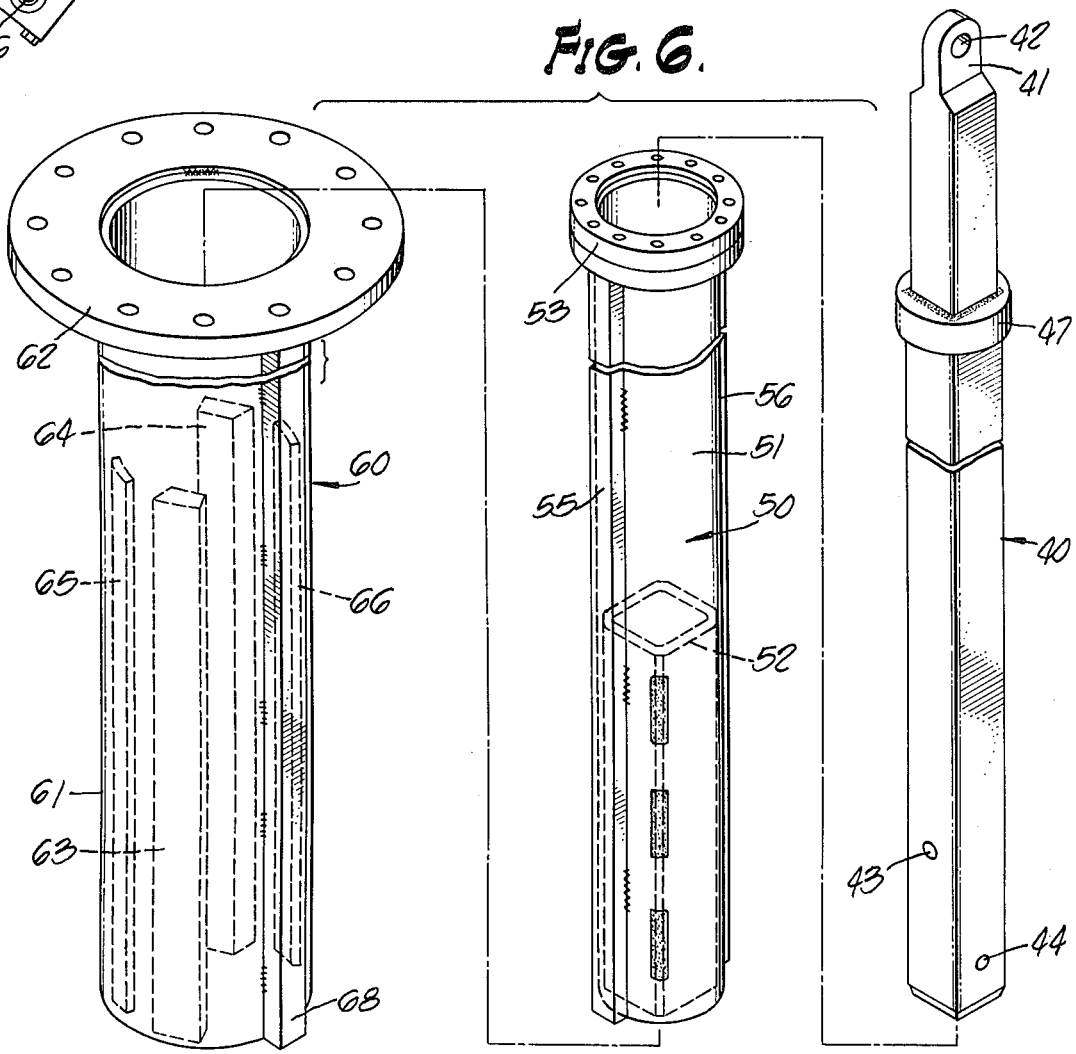

9
9
10
10
11
11
12
12
13
13
K
141b
141a
141
140
146
143a
142
144
143
143b
40
148
151
152
153
150
120
104
68
124
61
I
111
130
21
13
160
161
12
11
60
100
101
67
121
50
51
112
131
20

FIG. 9.
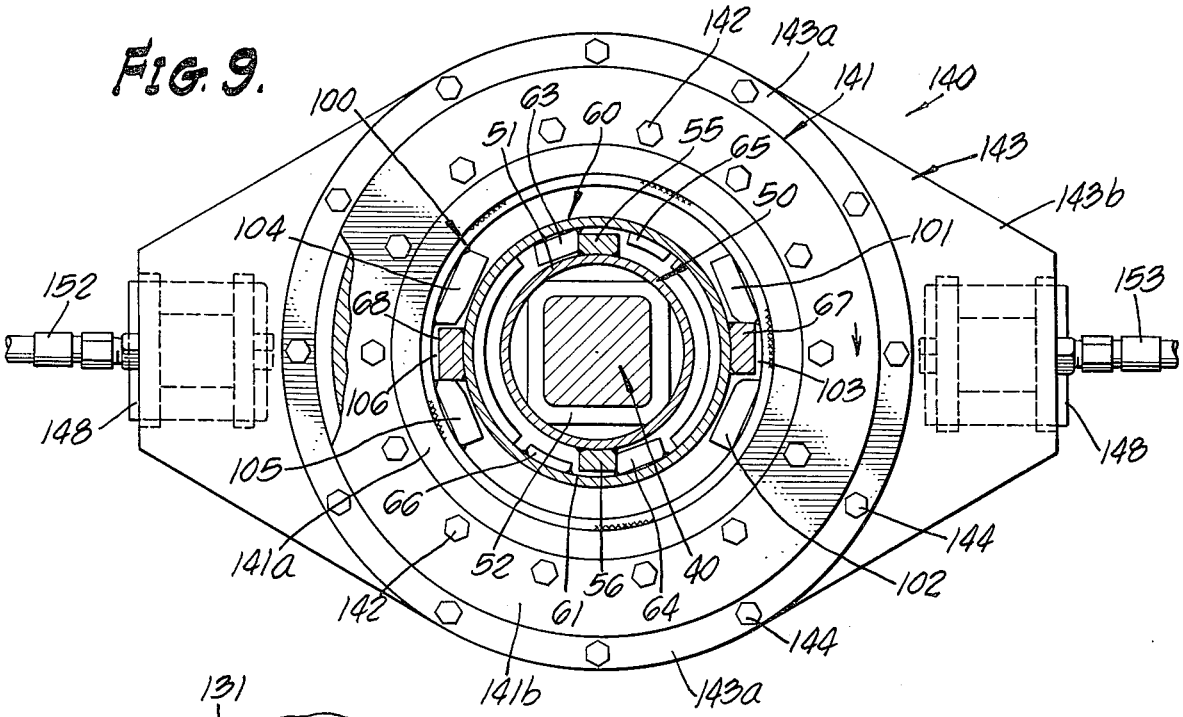
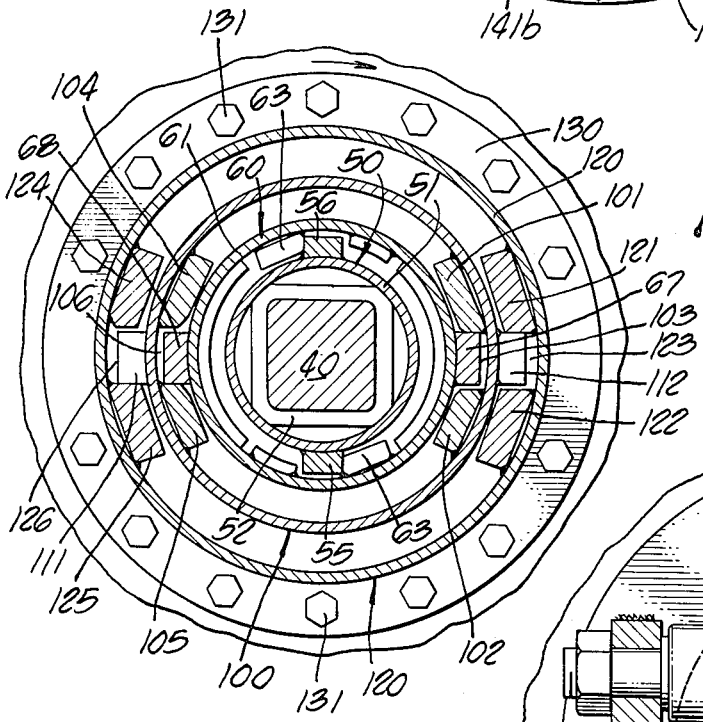
FIG. 10.
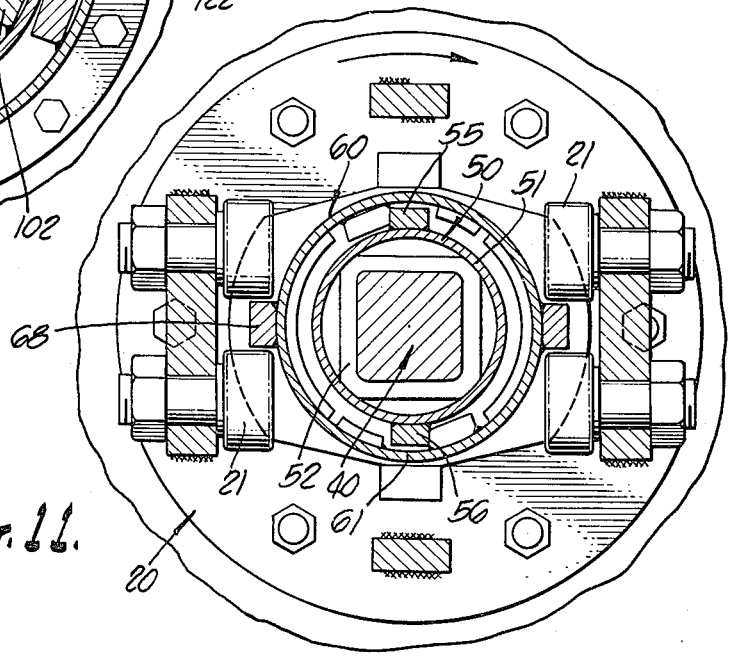
FIG. 11.

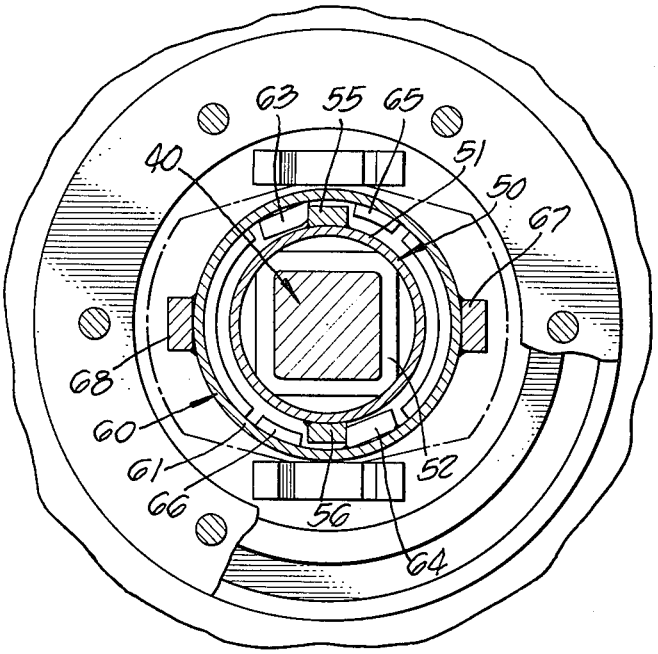
FIG. 12.
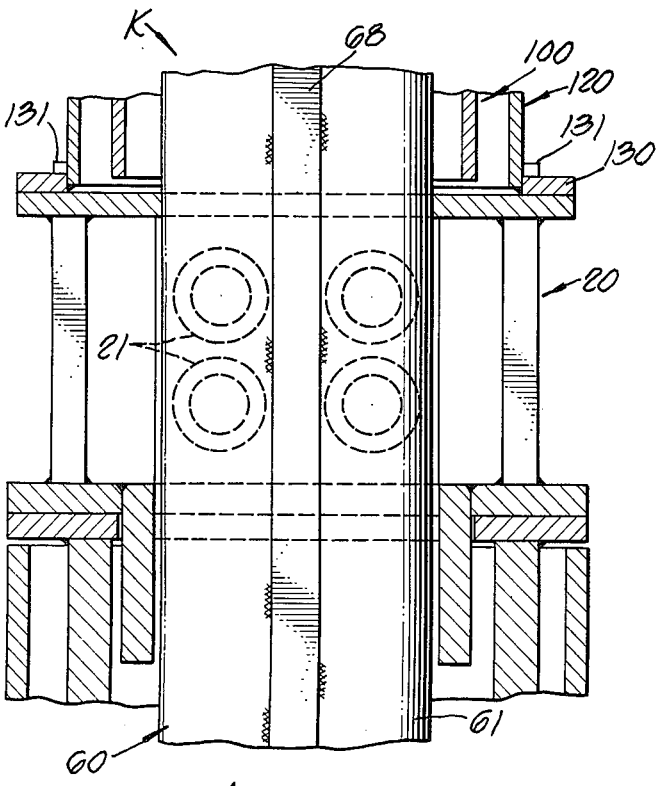
FIG. 13.
FIG. 14.
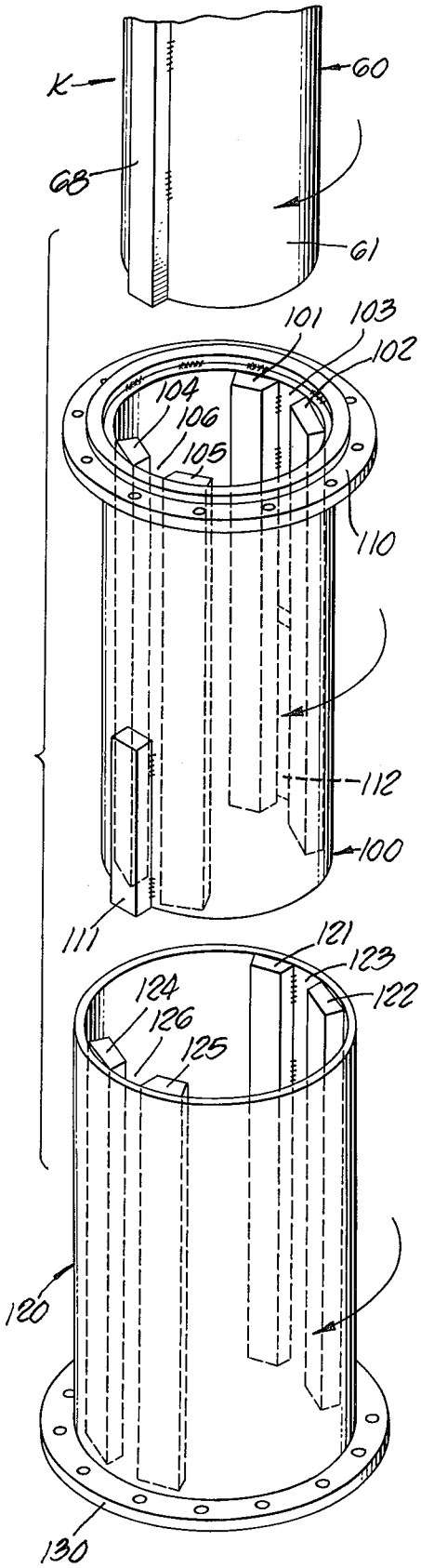

KELLY CROWD FOR VERTICAL DRILL RIG

BACKGROUND OF THE INVENTION

In vertical drill rigs it has long been the established practice to utilize a drive kelly having a drilling tool supported from its lower end, and at some point along its vertical length the drive kelly passes through an opening in a rotary table which is drivingly rotated for imparting a rotating movement through the kelly to the drilling tool. If the hole being drilled is very shallow, or the formation is very soft, the vertical drive of the drilling tool can be accomplished by gravity along. That is, the combined weight of the drilling tool and the drive kelly are sufficient to drive the drilling tool downward at the necessary rate of travel.

In many instances, however, when the depth of the hole becomes greater, or the formation being cut is relatively hard, then the mere weight of the equipment is no longer sufficient to accomplish the drilling action at a satisfactory rate of speed. It then becomes necessary, or at least economically advantageous, to accelerate the downward travel of the drilling tool by "crowding" the kelly.

It has heretofore been known to utilize a crowd mechanism having a positive drive, such that a powered downward movement of the crown mechanism is fully and directly imparted to the drive kelly and hence to the drilling tool. Another known type of crowd mechanism is the friction crowd in which another member is placed in longitudinal sliding engagement with the drive kelly, and is moved downwardly in order to at least partially transmit its downward movements through the drive kelly to the drilling tool.

In drilling relatively deep holes such as 100 feet or more it is generally the practice to utilize either a double kelly or a triple kelly. Thus the kelly is provided with multiple sections which have a longitudinally collapsed position in which they are concentrically arranged, or which may be longitudinally extended so that each section overlaps a small portion of the length of the next.

It will be evident that the arrangement of the vertical drill rig including its rotary table, drive kelly, and crowd mechanism, becomes a rather complex problem when an effort is made to achieve maximum drilling speeds, maximum depth of hole to be cut, and at the same time maintaining the original cost of equipment as well as the maintenance expense thereof at minimum levels.

It is, therefore, the purpose and object of the present invention to provide a kelly crowd for a vertical drill rig which has advantages not obtainable with previously known types of crowd mechanism. A further object of the invention is to modify a vertical drill rig in an appropriate manner to incorporate an improved crowd mechanism therein.

DRAWING SUMMARY

FIG. 4 is a horizontal cross-sectional view taken on line 4—4 of FIG. 3;

FIG. 5 is a horizontal cross-sectional view taken on line 5—5 of FIG. 3;

FIG. 6 is a perspective view of the triple kelly when disassembled;

FIG. 9 is a horizontal cross-sectional view taken on the line 9—9 of FIG. 8;

FIG. 10 is a horizontal cross-sectional view taken on the line 10—10 of FIG. 8;

FIG. 11 is a horizontal cross-sectional view taken on the line 11—11 of FIG. 8;

FIG. 12 is a horizontal cross-sectional view taken on the line 12—12 of FIG. 8;

FIG. 13 is a fragmentary elevational section view taken on line 13—13 of FIG. 8;

FIG. 14 is an exploded perspective view of the crowd sleeves of the present invention;

GENERAL DESCRIPTION

Figure 1:
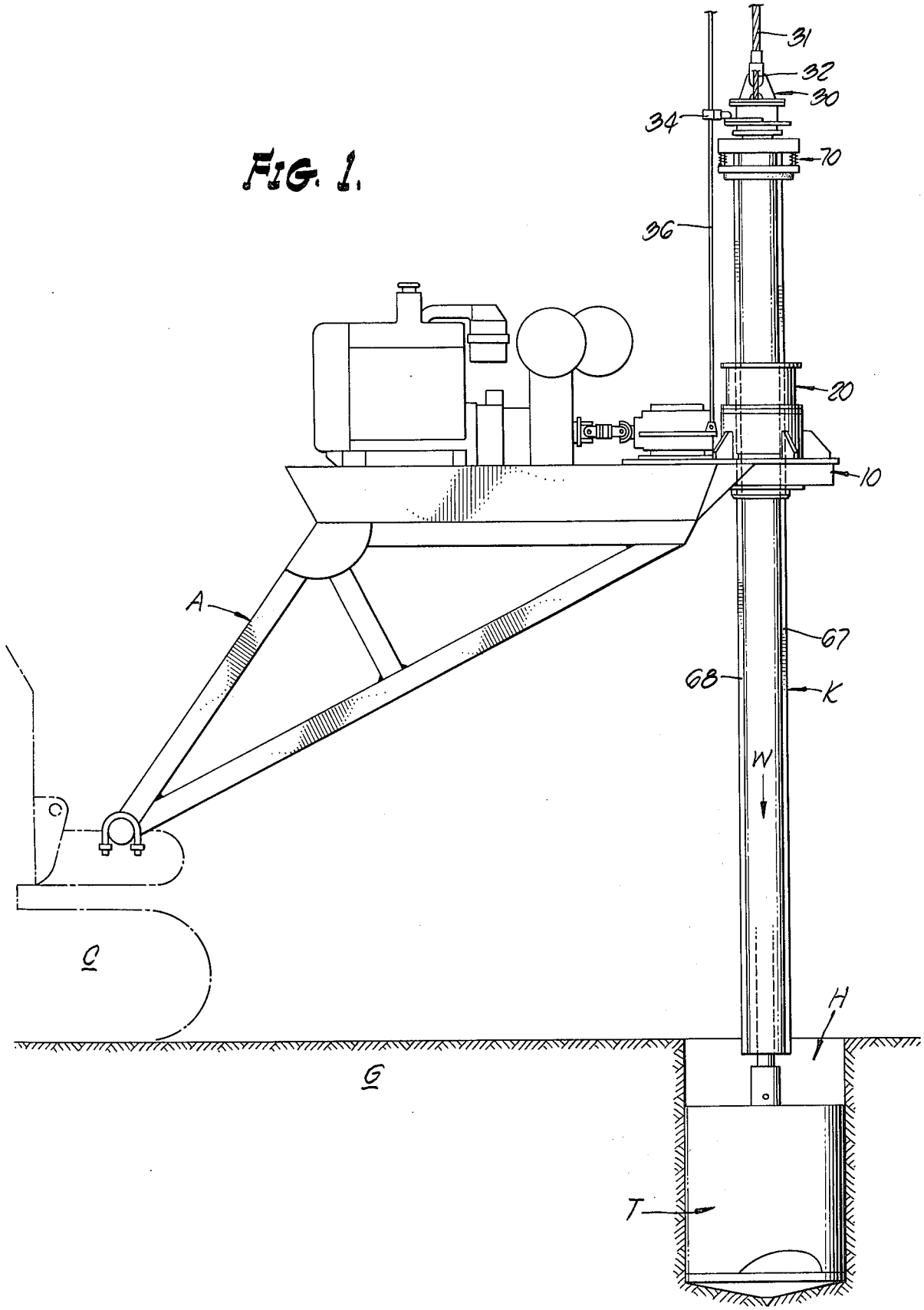
FIG. 1 is an elevational view of a conventional vertical drill rig incorporating a triple drive kelly.

Most of the illustrated apparatus is conventional. In the drawings the various main parts of the apparatus are identified by letter designations having a descriptive or suggestive nature, as follows:

C Crawler-mounted crane
A Crane attachment (To make a drill rig)
K Drive kelly
T Drilling tool (Bucket)
G Ground or earth formation to be drilled
I The invention, kelly crowd assembly

CONVENTIONAL MACHINE

Reference is now made to drawing FIGS. 1 and 3 through 6, inclusive, illustrating a conventional vertical drill rig. A crawler-mounted crane C, FIG. 1, is equipped with a crane attachment A for purpose of converting the crane into a vertical drill rig. Attachment A is typically about the size of an automobile and weighs about four or five tons. Completing the drill rig are a drive kelly K which is supported from the cable of the crane and which in turn supports a drilling tool T from its lower end. While augers are frequently used, the presently illustrated drilling tool is of the bucket type.

As also shown in FIG. 1, the crawler or other vehicle which supports the crane C is of course supported upon the surface of ground G, while the purpose of the completed drill rig is to drill a vertical hole H in the upper surface of the ground. As is well-known, machines of this type are not restricted to a precisely vertical operation, but may be effectively used at drilling angles which depart from the vertical by about 20 degrees or perhaps more.

It is necessary to the operation of the vertical drill rig that a certain amount of downward force be exerted upon the drilling tool T. To some extent this force is provided by gravity, i.e., the combined weight of drilling tool T and the drive kelly K. An arrow W in FIG. 1 indicates this gravitational force.

Crane attachment A, FIG. 1, at its forward extremity includes a rotary table 10. A roller drive unit 20 is supported upon the rotary table and extends above it. The roller drive unit contains a number of rollers 21 (FIGS. 7, 8 and 11) for engaging the drive kelly K in order to impart a rotary drive thereto while at the same time permitting the kelly to freely move in a vertical direction through the rotary table.

Figure 3:
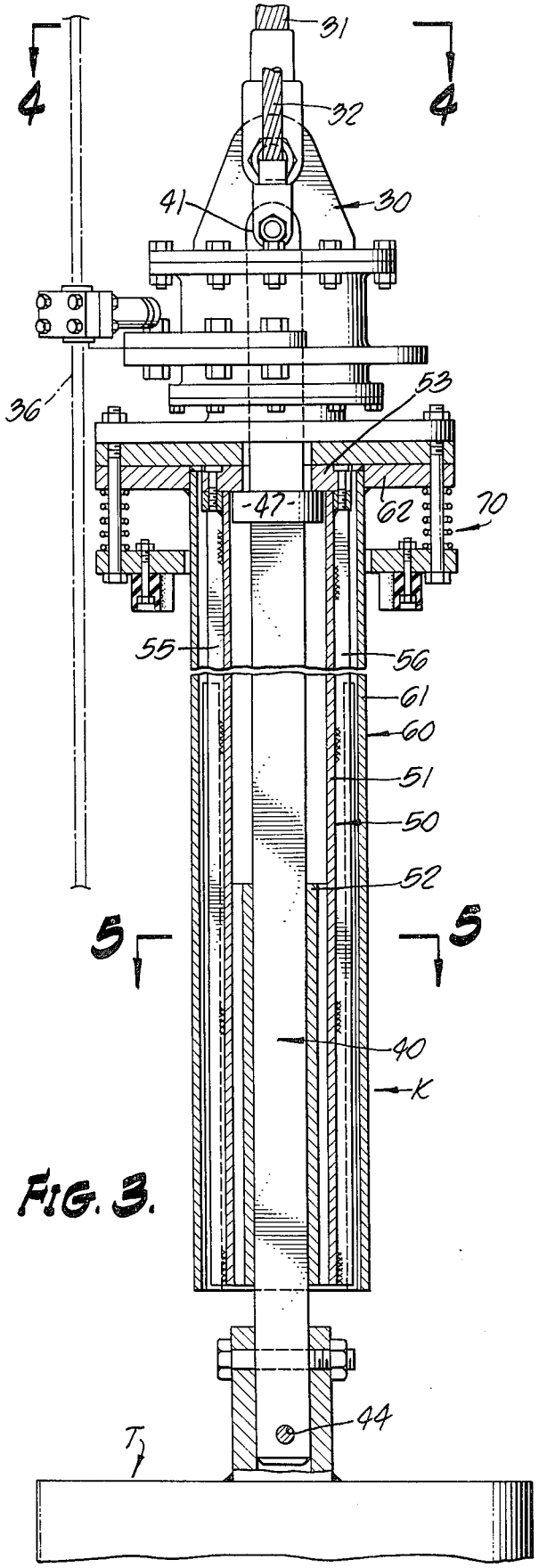
FIG. 3 is an elevation view, partially in cross-section, of the triple kelly assembly and other associated parts of the drill rig of FIG. 1.

A kelly swivel 30, FIGS. 3 and 4, is supported by the free or auxiliary line 31 of the crane. Stabilizer arms 33, 34 are arranged about 120° apart, FIG. 4, and extend to the sides of the kelly swivel and somewhat rearwardly thereof, towards attachment A. A pair of stabilizer lines 35, 36 are suspended from the boom of the crane, not shown, and extend downwardly so that their lower ends are secured to attachment A near the rotary table 10, for purpose of supporting attachment A in its desired operating position as shown in FIG. 1. The arms 33, 34 are also equipped with respective cable guides through which the stabilizer lines 35, 36 pass. The securement of the kelly swivel 30 to the lines 35, 36 by means of the stabilizing guides and arms tends to prevent or minimize a whipping action which might otherwise occur and which could disrupt the proper conduct of the drilling operation.

FIG. 6 shows the inner kelly section 40, the intermediate kelly section 50, and the outer kelly section 60. Inner kelly section 40 is square throughout most of its length. On its upper end there is an attachment lug 41 having an eye or opening 42 therein, to which a kelly line 32 is attached. Kelly line 32 also extends downwardly from the boom of the crane. While auxiliary line 31 remains at a fixed elevation for supporting the kelly swivel 30 at a fixed elevation, the crane mechanism is controlled by the operator so as to selectively raise or lower the kelly line 32 as may be required by the drilling operation. The relative positions of lines 31, 32 are shown in FIGS. 3 and 4. As also shown in FIG. 6, the inner kelly 40 has on its lower end a pair of transverse openings 43, 44 which are used for purpose of attachment of the drilling tool T thereto.

The intermediate kelly section 50 includes a cylindrical tube 51 having a square tube 52 fitted therein. The corners of square tube 52 are permanently secured to the interior wall of cylindrical tube 51. See FIG. 5. The interior size of square tube 52 is such as to accommodate the inner kelly bar 40 therein, with a reasonable degree of spacing so as to allow a relatively free longitudinal sliding movement of the kelly bar 40. A ring 53 is attached to the upper end of tube 51 to form an overhanging collar thereon. A pair of longitudinally extending ribs 55, 56 are welded to the exterior surface of tube 51 on opposite sides thereof and extend throughout the full length of the tube 51.

Outer kelly section 60 includes a cylindrical tube 61. A flat ring 62 is attached to the upper end of tube 61 to provide an overhanging collar thereon. The ring has a central opening whose diameter is equal to that of the interior diameter of the tube 61. A pair of relatively short ribs 63, 64 are secured to the interior wall of tube 61 in the lower end portion thereof. Ribs 63, 64 are directly opposite to each other. Another short rib 65 is adjacent the rib 63 to provide a keyway therebetween. A similar rib 66 provides a keyway in conjunction with rib 64. In the assembled condition of the kelly these keyways are occupied by the ribs 55, 56, respectively of the intermediate kelly section 50. See FIG. 5.

Near its upper end the inner kelly section 40 is provided with a cylindrical collar 47 having a relatively short length. Collar 47 fits within the tube 51 in an adequately spaced sliding relationship therewith. The square tube 52 of the intermediate kelly section 50 is of relative short length, being located only in the lower end portion of the kelly section 50. When the inner kelly section 40 is lowered relative to the intermediate section 50, a lower limit of travel is reached when the collar 47 comes to rest upon the upper end of the square tube 52.

The ring or collar 53 of intermediate kelly section 50 is of such size as to fit within the tube 61 in an adequately spaced sliding relationship therewith. When the intermediate kelly section 50 travels downwardly relative to the outer kelly section 60, a lower limit of travel is established when the ring 53 comes to rest upon the upper ends of the short ribs 63 through 66, inclusive.

The outer kelly section 60 is also equipped with a pair of exterior longitudinal ribs 67, 68, which are secured to the outer wall surface of the tube 61 and extend for the full length thereof. These exterior ribs are utilized for imparting a rotary motion to the complete kelly assembly, either by the conventional roller drive unit 20 when the kelly crowd assembly of the present invention is not being used, or by the kelly crowd assembly when it is being used.

It will be understood that the drilling tool or bucket T is suspended directly from the kelly line 32 being coupled therewith through the inner kelly section 40. The raising and lowering of the drilling tool is therefore accomplished by the raising or lowering of the line 32 and is accompanied by a corresponding vertical movement of the inner kelly section 40. The movement of inner kelly section 40, however, is guided both vertically and rotationally by the intermediate kelly section 50. The movement of intermediate kelly section 50, in turn, is guided both vertically and rotationally by the outer kelly section 60. It will be seen in FIG. 3 that the ring 53 of the intermediate kelly section extends somewhat inwardly from the interior wall of tube 51, leaving an opening which is large enough for he upper extremity of the inner kelly section 40 but which is not large enough for the collar 47 to pass therethrough. The raising of the inner kelly section 40 to its upper limit position as shown in FIG. 3, therefore, is also effective to raise the intermediate kelly section 50 to the same upper limit position.

The entire kelly assembly is supported from the kelly swivel 30 by attachment of the ring or collar 62 of the outer kelly section to the swivel. However, this is not a rigid coupling, because the action of the drilling tool will frequently cause bumps and jerks and vibrations which ought not to be transmitted to the kelly swivel. Therefore, a shock absorber assembly 70 of conventional construction, shown in some detail in FIG. 3, is utilized to provide a resilient attachment of the kelly assembly to the kelly swivel.

In the conventional vertical drilling machine as shown in FIGS. 1 and 3 through 6, the length of each section of the triple kelly assembly may typically be about 40 feet. The diameter of the drilling bucket, or auger if such is desired, may be in the range of about 1 foot to about 6 feet. While as background information for the present invention there has been illustrated a drill rig which is formed by securing a special attachment to a standard crane, it will nevertheless be understood that the applicability of the present invention is not thus limited, and that the invention in fact may apply to many other types of construction of a vertical drilling machine.

FIGS. 7, 8, 11, 12, and 13 also show details of the conventional rotary table, roller drive unit, and kelly assembly.

KELLY CROWD ASSEMBLY

Reference is now made to FIGS. 7, 8, 9, 10, 13, 14, and 15 illustrating the kelly crowd assembly of the present invention. Particular reference is first made to FIG. 14.

The kelly crowd assembly I of the present invention includes an inner sleeve 100 and an outer sleeve 120, both as shown in perspective in FIG. 14. The inner sleeve 100 has a pair of longitudinally extending ribs 101, 102 fastened to the interior wall thereof which cooperatively form a keyway 103. On the opposite side it has ribs 104, 105, forming a keyway 106. A ring 141*a* attached to the upper end of sleeve 100 provides an outwardly extending collar thereon. A pair of short longitudinally extending ribs 111, 112 are attached to the lower end of sleeve 100 on the exterior surface thereof.

Outer sleeve 120 has a pair of longitudinally extending interior ribs 121, 122 which cooperatively form a keyway 123. On the opposite side of the sleeve are ribs 124, 125 which cooperatively form a keyway 126. A ring 130 attached near the lower end of sleeve 120 forms a circumferentially extending collar thereon.

The cooperative relationship of the parts in their assembled form is well illustrated in FIG. 10. External ribs 67, 68 of the kelly assembly are received within respective keyways 103, 106 of the internal crowd sleeve 100. External ribs 111, 112 of the crowd sleeve 100 are received in respective keyways 123, 126 of the external crowd sleeve 120. A rotating drive imparted to the external crowd sleeve 120 therefore produces rotation of both the internal crowd sleeve 100 and the kelly drive assembly.

Figure 15:
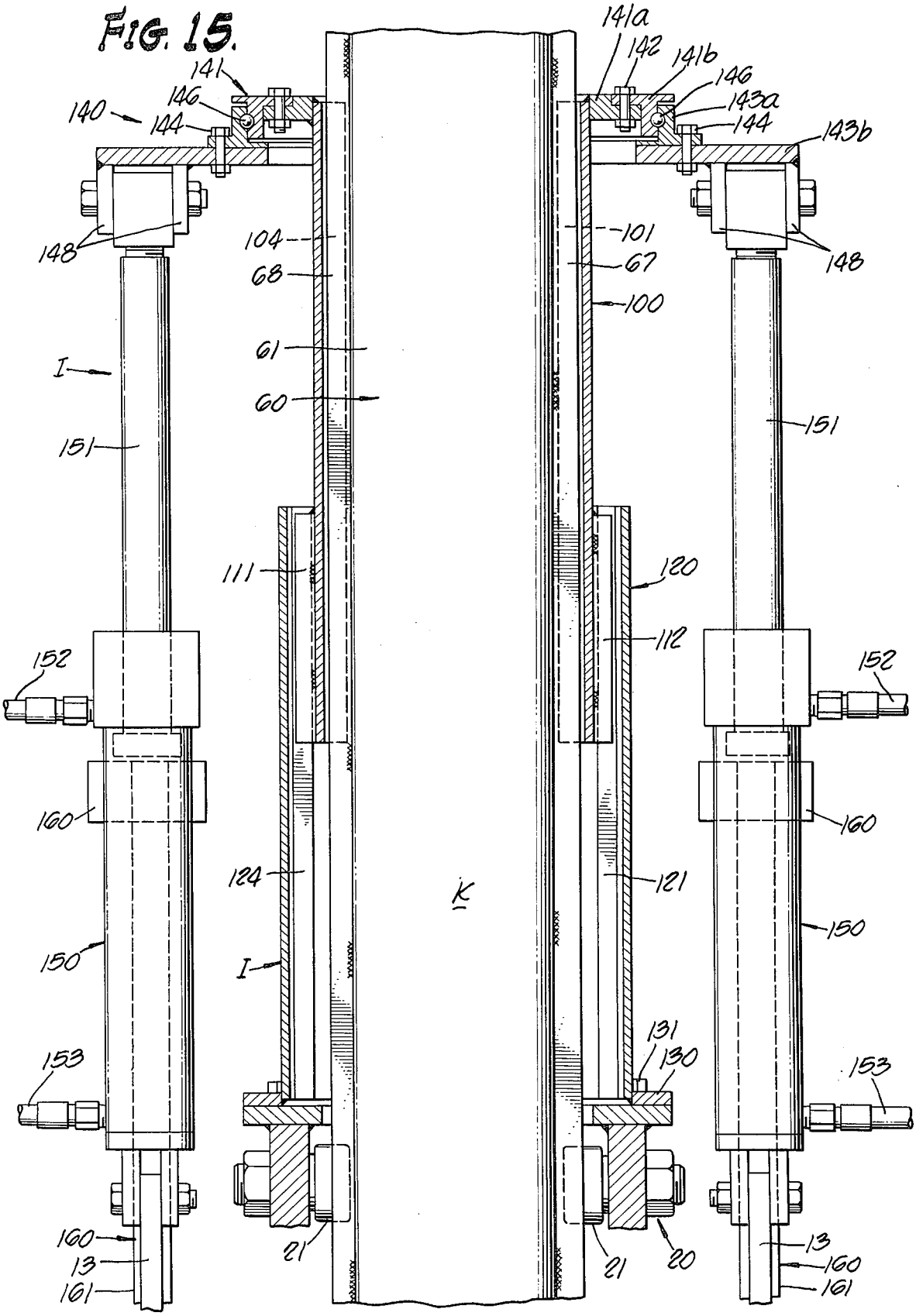
FIG. 15 is an elevation view, partially in cross-section, of the crowd assembly in its raised or extended position.

In the assembled form of the apparatus as shown in FIGS. 13 and 15 the flange 130 at the lower end of outer crowd sleeve 120 is attahced to the upper end of roller drive unit 20. This attachment is made by means of a circumferential row of bolts 131 which may be removed when it is desired to detach the external drowd sleeve from the machine.

Also included in kelly crowd assembly I is a bearing assembly 140, FIG. 15. The bearing assembly includes an inner ring 141 consisting of separate inner and outer parts 141*a*, 141*b* which are detachably fastened together with bolts 142. The bearing assembly also includes an outer ring 143 consisting of an inner part 143*a* and an outer part 143*b* which are detachably fastened together by means of bolts 144. Roller bearings 146 contained in a raceway cooperatively formed by the parts 141*b*, 143*a* support the two rings for relative rotation. The inner part 141*a* of inner ring 141 is permanently secured, as by welding, to the exterior upper surface of the inner crowd sleeve 100.

As best seen in FIG. 9, the ring part 143*b* is enlarged on two opposite sides of the crowd assembly to provide a pair of laterally extending ears. A corresponding hydraulic cylinder 150 has its upper end attached to the under surface of each of these ears (see FIG. 15). The lower end of each hydraulic cylinder is attached to the base of rotary table 10, FIG. 8.

Figure 2:
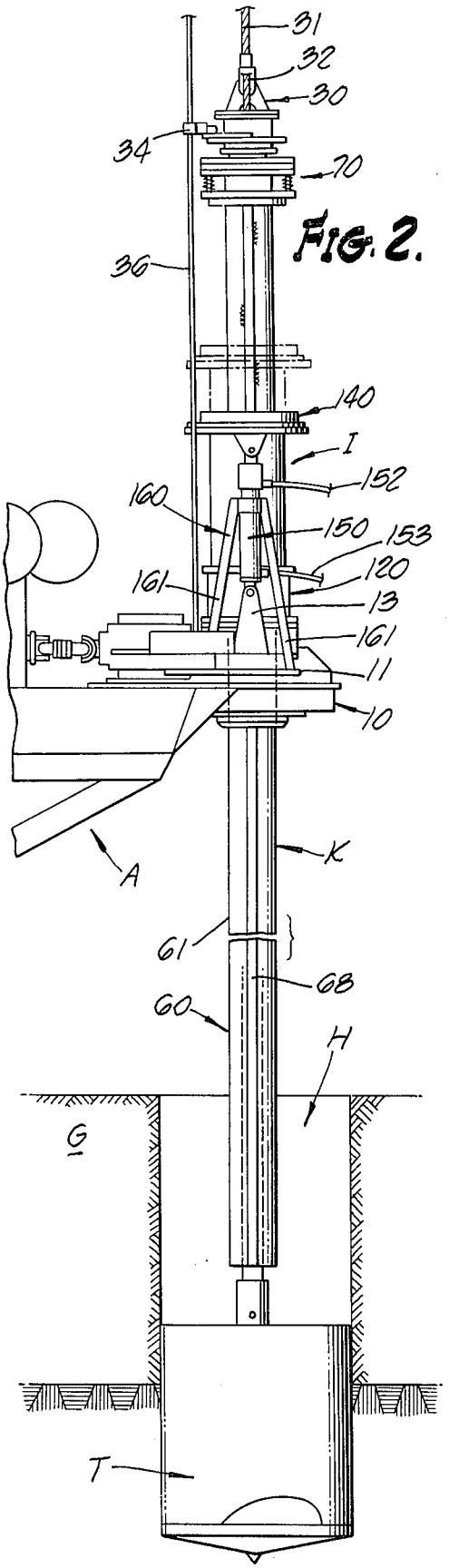
FIG. 2 is a fragmentary side elevation view of the drill rig of FIG. 1 which has been modified to incorporate the crowd assembly of the present invention.
Figure 7:
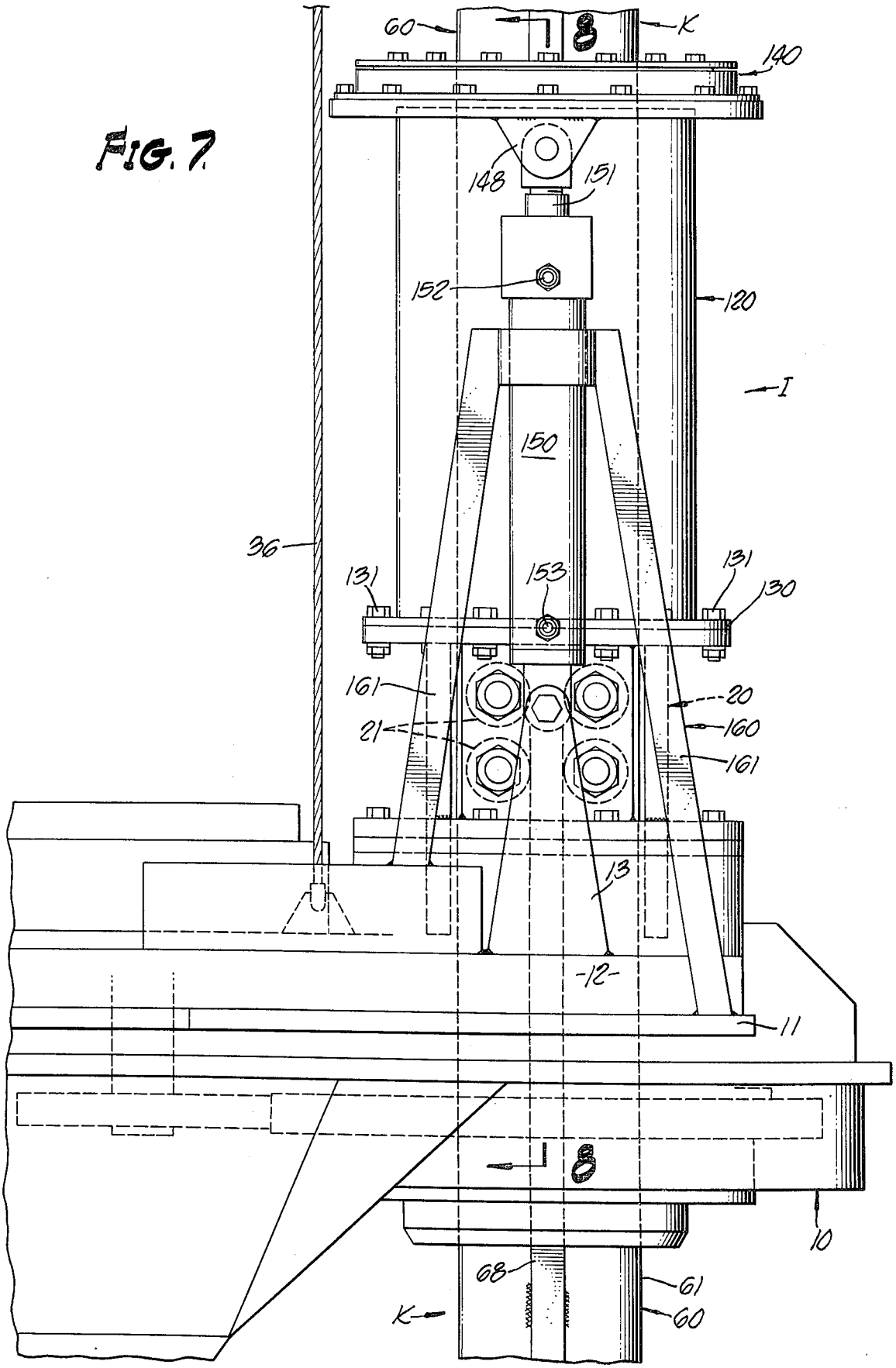
FIG. 7 is an elevation view of the crowd assembly of the present invention as it is incorporated in the machine of FIG. 2.
Figure 8:
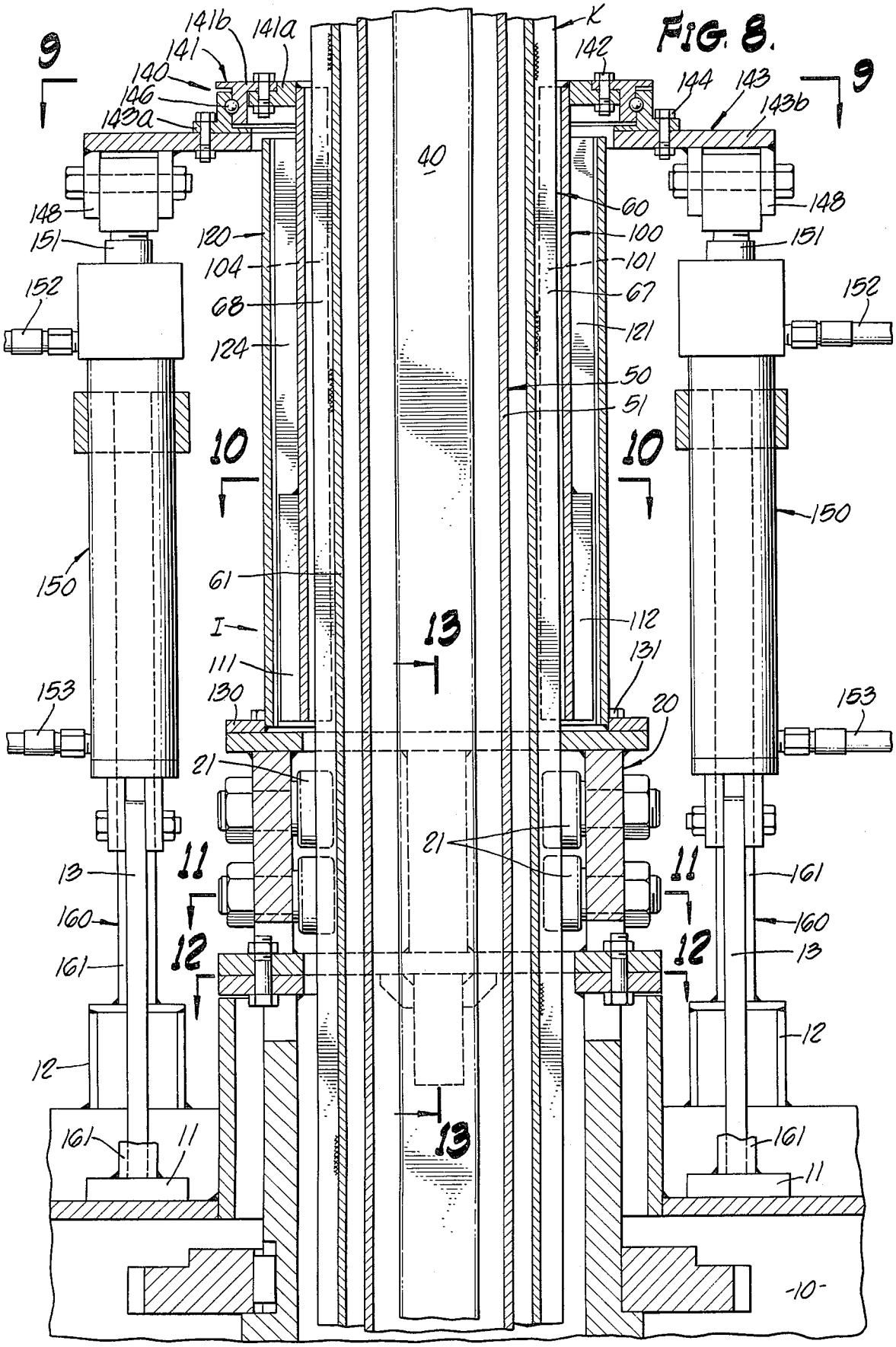
FIG. 8 is a cross-sectional elevational view of the crowd assembly, triple kelly, and related apparatus, taken on the line 8—8 of FIG. 7.

More specifically, as best shown in FIGS. 2 and 7 there is a generally V-shaped guide frame 160 which supports each of the hydraulic cylinders 150. The support frame 160 has its legs 161 permanently attached to a stationary base 11 which is associated with the rotary table 10. Viewing FIGS. 7 and 15 together it can also been seen that another fixed base 12 has an upward extension 13 to which the lower end of cylinder 150 is pivotally attached. Piston shaft 151 forming the upper portion of hydraulic cylinder 150 is pivotally attached to ears 148 which are secured to the under side of the bearing part 143*b*. Hydraulic lines 152, 153 are coupled to respective ends of the cylinder 150 for controlling the extension or retraction of the shaft 151.

The inner crowd sleeve 100 may be removed from the machine in the following manner. Bolts 144 are detached for releasing the bearing part 143*a* from the bearing part 143*b*. After detachment of drilling tool T, crane lines 31, 32 are raised concurrently in order to lift the kelly assembly K through the crowd assembly I. The inner crowd sleeve 100 may then be lifted upward and out, carrying with it the bearing ring 141, bearings 146, and outer ring part 143*a*.

OPERATION

When drilling shallow holes or in soft formation the kelly crowd assembly I may not be needed. It can then be removed from the machine. Roller drive unit 20 will then impart rotary motion directly to the kelly assembly K via the external ribs 67, 68 of the outer kelly section 60.

When the kelly crowd is to be used, the operation is as follows. The various individual guide rollers 21 contained within the roller unit 20 may be detached before the machine is placed in operation; or alternatively, they may simply be left in place.

Since the outer crowd sleeve 120 is directly attached to the roller drive unit 20 it is rotatably driven by the operation of the rotary table 10. Keyways 123, 126 which capture the short ribs 111, 112 serve to impart the rotary drive to the inner crowd sleeve 100. Keyways 103, 106 of the inner crowd sleeve in turn transmit the rotary drive motion to the external ribs 67, 68 of the kelly assembly K.

The hydraulic cylinders 150 may be activated for selectively raising or lowering the bearing assembly 140, as may be desired. Crowding of the kelly is achieved by first placing the bearing assembly in an elevated position as shown in FIG. 15. Then the rotary drive is started. Then with the rotary drive in operation the cylinders 150 are energized in the reverse direction so as to retract the piston shafts 151 in a downwardly direction. This action pulls the upper end of the inner crowd sleeve 100 downwardly, hence causing the entire sleeve to move in a downwardly direction. The ribs 101, 102 and 104, 105 of the inner crowd sleeve 100 then slide longitudinally downwardly relative to the outer kelly ribs 67, 68. The longitudinal sliding friction creates a downwardly force upon the kelly assembly and also upon the drilling tool T which is in excess of, and additive with, the force of gravity thereon.

ALTERNATE FORMS

While the invention as presently disclosed utilizes a pair of crowd sleeves which extend upwardly above the rotary table, the same principles of construction may be applied in arranging the crowd sleeves to extend downwardly below the rotary table. While particular interengaging rib and keyway constructions have been shown, it will be understood that other and different types of keyway constructions, gear teeth, or the like may be used if desired. Alternatively, the various concentric sleeves may be made of a square or other regular polygonal construction so that each one will rotatably drive the next without the necessity for special keyways or ribs or gear teeth.

While the invention has been illustrated in conjunction with a vertical drilling machine of the type that is constructed by adding parts to a standard crane, it will nevertheless be understood that the structure and principles of the invention are equally applicable to other types of vertical drilling machines.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In a vertical drilling machine, a kelly crowd apparatus comprising, in combination:

a generally vertically disposed drive kelly having longitudinally extending keyway means formed on the exterior surface thereof;

a hollow inner sleeve circumdisposed about said drive kelly and having longitudinally extending keyway means formed on both the interior and exterior wall surfaces thereof, said interior keyway means of said inner sleeve cooperating with the keyway means on said drive kelly for rotatingly driving the same;

a hollow outer sleeve circumdisposed about said inner sleeve and having longitudinally extending keyway means formed on the interior wall surface thereof, said keyway means of said outer sleeve cooperating with the exterior keyway means of said inner sleeve for drivingly rotating the same;

means for supporting said outer sleeve at a relatively fixed elevation;

rotating drive means adapted for drivingly rotating said outer sleeve about its longitudinal axis, so as to drivingly rotate both said inner sleeve and said drive kelly; and separately controlled drive means coupled to said inner sleeve and operable for selectively lowering the same so as to impart a longitudinal frictional drive force to said drive kelly which adds to the force of gravity thereon.

2. Apparatus as in claim 1 wherein said outer sleeve is supported from one of its ends and said separately controlled drive means is attached to the opposite end of said inner sleeve.

3. Apparatus as claimed in claim 2 wherein said supporting means is attached to the lower end of said outer sleeve, and said separate drive means is attached to the upper end of said inner sleeve.

4. Apparatus as in claim 2 wherein said rotating drive means is a rotary table having a fixed supporting base, said outer sleeve being attached to said base.

5. Apparatus as in claim 4 wherein said rotary table also includes a roller drive unit.

6. Apparatus as in claim 3 wherein both of said sleeves are detachable from their respective supports.

7. Apparatus as in claim 1 wherein said drive kelly has at least two longitudinal sections which are concentrically disposed.

8. In a vertical drilling machine, kelly crowd apparatus comprising, in combination:

a drive kelly and inner and outer sleeves concentrically circumdisposed thereabout, said sleeves having first cooperably interengaging keyway means and said inner sleeve and drive kelly having second cooperably interengaging keyway means, whereby a rotating drive imparted to said outer sleeve will be imparted through said inner sleeve to said drive kelly;

means for supporting a drilling tool from the lower end of said drive kelly; and separately controlled drive means for selectively lowering the elevation of said inner sleeve relative to said outer sleeve whereby a sliding friction force is imparted via said second keyway means and said drive kelly to said drilling tool so as to add to the gravitational force thereon.

9. A vertical drilling machine comprising:

a rotary table having a roller drive unit therein, said roller drive unit having an opening therethrough;

a drive kelly extending through said opening and having external rib means adapted to be rotatably driven by said roller drive unit concurrently with the longitudinal movement of said drive kelly through said opening;

a drilling tool supported from the lower end of said drive kelly; and a friction crowd assembly including a pair of concentric sleeves each supported from said rotary table, the outer one of said sleeves being adapted to transmit rotary motion from said rotary table to the inner sleeve, and said inner sleeve being adapted to transmit rotary motion to said drive kelly;

said inner sleeve being vertically movable relative to said outer sleeve, and said drive kelly and inner sleeve having interengaging rib and keyway means for imparting a downward longitudinal frictional force from said inner sleeve to said drive kelly;

said crowd assembly being removable when not required by the formation hardness or depth of cut in a hole being drilled.

10. A vertical drilling machine comprising:

a power drive rotary table having a vertical opening therethrough;

an elongated drive kelly which is substantially vertically disposed and extends through said opening;

a drilling tool supported from the lower end of said drive kelly;

a hollow, generally cylindrical outer sleeve disposed about said drive kelly and having one of its ends rigidly attahced to said rotary table to rotate therewith, said outer sleeve also having longitudinally extending keyway means formed on the inner wall surface thereof;

a hollow, generally cylindrical inner sleeve having longitudinally extending keyway means formed on both the outer and inner wall surfaces thereof, said inner sleeve being disposed about said drive kelly and having one end portion thereof received within the otherwise free end of said outer sleeve, said keyway means of said outer sleeve engaging the exterior keyway means of said inner sleeve so as to impart a rotating drive to said inner sleeve;

the interior keyway means of said inner sleeve cooperating with the external surface of said drive kelly so as to transmit the rotary movement thereto; and separate drive means for selectively raising or lowering said internal sleeve relative to said external sleeve;

whereby when said internal sleeve is driven downwardly the longitudinal sliding friction between the interengaging keyways of said inner sleeve and said drive kelly provides a downward force upon said drilling tool which is in addition to the gravitational force imposed thereon by said drive kelly.

11. The apparatus of claim 10 wherein said outer sleeve is positioned above said rotary table and the lower end of said outer sleeve is attached to said rotary table.

* * * * *